United States Patent [19]

Parker

[11] 4,283,658

[45] Aug. 11, 1981

[54] PROJECTION LAMP CONTROL ARRANGEMENT

[75] Inventor: Robert R. Parker, Wheeling, Ill.

[73] Assignee: Bell & Howell Company, Chicago, Ill.

[21] Appl. No.: 48,308

[22] Filed: Jun. 13, 1979

[51] Int. Cl.[3] ..... H05B 41/36; H01J 61/52

[52] U.S. Cl. ..... 315/117; 315/307; 353/57

[58] Field of Search ..... 315/112, 117, 309, 307; 313/13; 353/52, 57, 85; 355/30

[56] References Cited

U.S. PATENT DOCUMENTS

| | | | |
|---|---|---|---|
| 2,315,919 | 4/1943 | Babcock | 315/117 |
| 4,146,819 | 3/1979 | Hunter | 315/117 |

*Primary Examiner*—Eugene R. LaRoche

*Attorney, Agent, or Firm*—James V. Lapacek; Roger M. Fitz-Gerald

[57] ABSTRACT

A control circuit is provided in projection apparatus to control the operating characteristics of the projection lamp. The projection lamp control circuit maintains a constant illumination output and color temperature of the projection lamp to provide improved operation and increased lamp operating life. The desired operating point of the projection lamp is accurately maintained by sensing the operating point of the projection lamp and utilizing the sensed deviation from the desired operating point to vary the output of a blower that provides cooling of the lamp. Thus, the operating point and color temperature of the projection lamp is accurately maintained in a closed loop arrangement by sensing the operating point of the lamp and controlling the blower output. The control arrangement provides a first predetermined blower output during the projection lamp-off mode, a second predetermined blower output (off in a specific arrangement) during the projection lamp ignition and start-up mode and a variable output in a closed loop arrangement during normal projection lamp operation.

20 Claims, 3 Drawing Figures

PROJECTION LAMP CONTROL ARRANGEMENT

BACKGROUND OF THE INVENTION

1. Field of the Invention

The present invention relates generally to the field of projection apparatus and projection lamp control and more particularly to a projection lamp control arrangement to accurately maintain the operating point and color temperature of a high intensity projection lamp.

2. Description of the Prior Art

Projection apparatus of the prior art utilizing high intensity projection lamps utilize blower or other ventilation devices to prevent the projection lamp from overheating. Typically, the blower runs at full output capacity independently of the operating characteristics of the projection lamp; namely, voltage and current operating levels, color temperature, etc. The output capacity of the blower depends upon the blower input voltage and thus the blower air flow varies over a rather wide range especially with fluctuations in the input line voltage.

In projection apparatus utilizing metal arc lamps, the cooling of the metal arc projection lamp is critical to obtain constant light output, proper color temperature and a long operating life. The operating point of the metal arc projection lamp depends on manufacturing parameters of the projection lamp and also the air flow or cooling medium of the projection lamp.

During the operating life of the projection lamp, the operating characteristics of the lamp change or age. For example, the electrodes of the projection lamp "burn back" during the operating life. This results in increased operating voltages when the projection lamp is supplied by a constant current projection lamp supply. Accordingly, increased power dissipation results causing a deviation from the desired operating point and a shortened operating life of the projection lamp.

Various arrangements of the prior art have attempted to provide a degree of control over the operation of lamps, discharge tubes and other electronic devices in various environments.

For example, U.S. Pat. No. 930,958 to G. K. Hartung discloses an air flow control arrangement wherein the voltage of a glow lamp is sensed to increased the air flow and maintain a constant operating temperature of the lamp. The air flow is controlled by the positioning of a damper and a central ventilation tube between air inlets and air outlets.

U.S. Pat. No. 2,080,908 to A. Bunger et al, U.S. Pat. No. 2,177,704 to V. J. Francis, U.S. Pat. No. 2,196,022 to E. E. Moyer and U.S. Pat. No. 2,279,941 to C. R. Dunham et al disclose various cooling and blower control arrangements where operation and the state of the cooling arrangement is modified in accordance with operating characteristics of an electronic device. Bunger and Francis are directed to cooling operation to bring about rapid operating cycles of a discharge device with rapid cooling after extinguishing of the discharge device to promote subsequent ignition. Dunham operates the blower when the lamp is in full operation, disables the blower during a heating up process and continues blower operation when the lamp has been extinguished for a rapid cool-down. Various distinct operational modes of the blower are thus determined by the voltage of the lamp. Moyer provides operation of a cooling system to anticipate a rise in temperature of an electrical valve device and includes temperature responsive means to maintain operation of the cooling system as long as the temperature of the electric valve exceeds a predetermined value. Low current of the electrical device is utilized to initiate operation of the cooling system.

U.S. Pat. No. 3,359,454 to W. N. Scheppe discloses a cooling system for a mercury vapor lamp wherein a lamp is not cooled during its warm-up period for fast warm-up and is rapidly cooled when the mercury vapor lamp is off to minimize the restart or recycle time. A two-speed fan blower is utilized to provide the most rapid cooling when the lamp is off and less cooling during normal operation.

U.S. Pat. No. 2,818,530 to C. G. Collar discloses a cooling system for a mercury cathode electron device with the grid current being utilized to control the cooling system. The blower motor of the cooling system remains on as long as the grid current is a predetermined value determined either instantaneously or in a time averaged manner.

U.S. Pat. No. 3,885,194 to B. W. Schumacher discloses an arrangement for controlling the temperature of a heated cathode of a high power electron beam gun to regulate the beam and maintain constant beam current during operation and prior to turn on. The thermionic ignition of a predetermined area of the cathode is measured and the measured signal utilized to control the temperature of the heated cathode.

U.S. Pat. No. 4,101,807 to H. M. Hill discloses a heater element for a low pressure metal or metal halide vapor lamp to control lamp temperature for optimum light output and to decrease the warm-up time of the lamp. An electrical control circuit measures the ratio of the heater voltage to the heater current and compares this ratio against a reference to control the heater current to maintain optimum temperature.

While the above-described arrangements are generally suitable for their intended use, these arrangements do not provide accurate operating point and color temperature control for a high intensity projection lamp in a closed loop by varying the output of a blower in response to sensed deviations from the desired operating point of the projection lamp.

SUMMARY OF THE INVENTION

Accordingly, it is a principal object of the present invention to provide a control arrangement in projection apparatus for accurately maintaining the operating point and color temperature of a high intensity metal arc projection lamp that avoids one or more disadvantages of the above-described arrangements.

It is another object of the present invention to provide a control arrangement for a projection lamp that varies the output of a blower providing cooling of the projection lamp in a closed loop manner and in response to sensed deviations of the operating point of the projection lamp from a desired operating point to accurately maintain a constant power input to the projection lamp and to increase the operating life of the projection lamp.

It is a further object of the present invention to provide a projection lamp control system having a variable output blower arrangement that provides a first predetermined blower output capacity during the projection lamp off-time, a second predetermined blower output capacity during projection lamp start-up time and a variable blower output in a closed loop arrangement during normal operation in response to the deviation of the projection lamp from a desired operating point to accurately maintain color temperature of the projection lamp.

These and other objects of the present invention are efficiently achieved by providing a control arrangement in projection apparatus to control the operating characteristics of the projection lamp. The projection lamp control circuit maintains a constant illumination output and color temperature of the projection lamp to provide improved operation and increased lamp operating life. The desired operating point of the projection lamp is accurately maintained by sensing the operating point of the projection lamp and utilizing the sensed deviation from the desired operating point to vary the output of a blower that provides cooling of the lamp. Thus, the operating point and color temperature of the projection lamp is accurately maintained in a closed loop arrangement by sensing the operating point of the lamp and controlling the blower output. The control arrangement provides a first predetermined blower output during the projection lamp-off mode, a second predetermined blower output (off in a specific arrangement) during the projection lamp ignition and start-up mode and a variable output in a closed loop arrangement during normal projection lamp operation.

BRIEF DESCRIPTION OF THE DRAWINGS

The invention, both as to its organization and method of operation, together with further objects and advantages thereof will best be understood by reference to the following detailed description taken in connection with the accompanying drawings wherein.

DESCRIPTION OF THE PREFERRED EMBODIMENT

Figure 1:
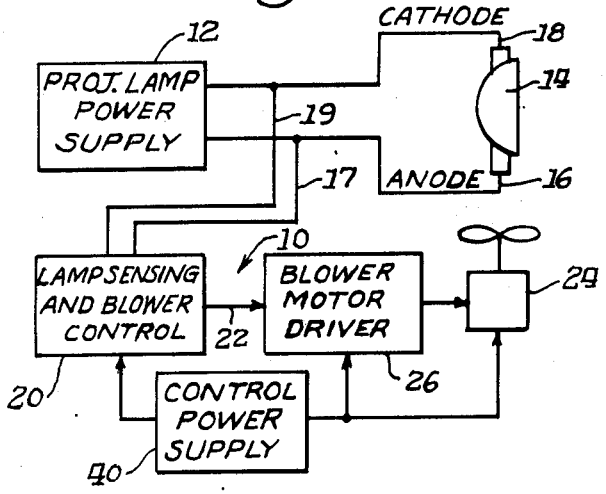
FIG. 1 is a block diagram and schematic representation of a control arrangement for a projection lamp in accordance with the principles and teachings of the present invention.

Referring now to FIG. 1, the projection lamp control arrangement in accordance with the principles of the present invention and referred to generally at 10 is connected in projection apparatus to sense the voltage at the output of a projection lamp power supply 12. The projection lamp power supply 12 is connected to a cathode electrode 18 and an anode electrode 16 of a projection lamp 14 over supply lines 19, 17 respectively. The projection lamp 14 is a high intensity illumination source and preferably a metal arc lamp although it should be understood that the teachings of the present invention are also applicable to other types of projection lamps. The use of a high intensity illumination source in projection apparatus is discussed in U.S. Pat. No. 4,093,366, U.S. Pat. No. 3,720,460 and an article entitled "Big Screen Projection", W. A. Williams, *Super 8 Filmaker,* Fall 1973, pp. 38–39.

The projection lamp power supply 12 provides a constant current to the projection lamp 14 after the projection lamp 14 is started. A high voltage pulse of approximately 12 kilovolts is utilized to accomplish the establishing of the arc in the metal arc projection lamp 14. A power supply of this general type and similar to the projection lamp power supply 12 is discussed in more detail in U.S. Pat. No. 4,093,366 and co-pending application Ser. Nos. 001,995 and 002,055 filed on Jan. 8, 1979 by Robert R. Parker, now U.S. Pat. Nos. 4,218,115 and 4,202,611, respectively, both owned by the assignee of this patent.

Briefly, the metal arc, high intensity projection lamp 14 requires a high voltage starting pulse during a first portion of the starting mode, phase 1, wherein the projection lamp 14 exhibits a high arc tube impedance. After the starting pulse is established in phase 1, there is a transition to a second phase, phase 2, during which the arc voltage across the cathode and anode electrodes of the projection lamp 14 is momentarily high, approximately 2 to 7 times the normal operating voltage for approximately 10 milliseconds, and then drops to about 40% of the normal operating voltage. In a third start-up phase, phase 3, the arc voltage gradually rises from the 40% operating level to the 100% operating level over a period of approximately 30 seconds. During normal operation, a metal arc projection lamp of one specific type utilizes a steady state operating voltage of approximately 38 volts and a constant current of approximately 7 amps.

Metal arc projection lamps of this type are available, for example, from General Electric and Sylvania. The General Electric series of metal arc lamps is referred to as the MARC Series (General Electric trademark) and the Sylvania series is referred to as the COLOR ARC Series (Sylvania trademark). Various model numbers of these lamps are available; for example, the GE Marc 300/16 and the Sylvania Color Arc 300/16.

During normal operation a constant current is supplied by the projection lamp power supply 12 through internal constant current output control arrangements. The operating voltage of the projection lamp 14 depends on the manufacturing parameters of the projection lamp and the air flow or cooling medium over the projection lamp 14. If the projection lamp 14 is in a constant environment regarding ambient temperature and fluid flow conditions, the operating temperature of the projection lamp 14 is proportional to the power input to the projection lamp 14. As projection lamps of this type age during the operating life, it is typical for the electrodes to "burn back" and for the arc voltage to increase. Without control of the operating point of the projection lamp 14 and as the arc voltage increases, more power is dissipated by the projection lamp 14 and the operating life is reduced. With a constant current supply to the projection lamp 14 by means of the projection power supply 12, the operating voltage delivered to the projection lamp 14 determines the power dissipation and is critical to illumination output, color temperature and the operating life of the projection lamp 14.

Thus, as the operating point of the lamp 14 varies from a desired operating point either due to manufacturing tolerances, aging, or changes in the operating environment, the temperature of the projection lamp 14 also varies. If the operating point of the projection lamp 14 increases and the lamp is not provided with increased air flow or cooling, the power input to the projection lamp 14 in response to the increased operating temperature increases still further. This situation if unchecked could result in an unstable and undesirably high power input and operating temperature of the projection lamp 14.

In accordance with important aspects of the present invention, the projection control arrangement 10 accurately maintains the operating point of the projection lamp 14 and provides variable cooling and air flow to the projection lamp 14 in accordance with the deviations in the output voltage to the projection lamp 14 from a nominal desired operating point. Thus, the projection lamp control arrangement 10 maintains accurate illumination output and color temperature of the projection lamp 14 at a nearly constant operating power input level and increases the operating life of the projection lamp 14. The control arrangement 10 utilizes the direct relationship between the operating voltage and the operating temperature of the projection lamp 14 as will be explained in more detail hereinafter.

The projection lamp control arrangement 10 includes a lamp sensing and blower control stage 20 connected to sense the operating voltage delivered to the projection lamp 14 at the output of the projection lamp power supply 12 to the cathode electrode 18 and the anode electrode 16. In response to the sensed operating voltage of the projection lamp 14, the lamp sensing and blower control stage 20 over output 22 controls the operation of a blower motor generally referred to at 24 through a blower motor driver circuit 26.

The lamp sensing and blower control stage 20 through the blower motor driver stage 26 provides a variable output of the blower motor 24 to accurately maintain a desired operating point of the projection lamp 14 in a closed loop arrangement.

While the present invention is described with the use of a variable output blower motor 24, it should be realized that the teachings of the present invention are also applicable to other variable cooling source arrangements or variable output air flow devices.

Figure 2:
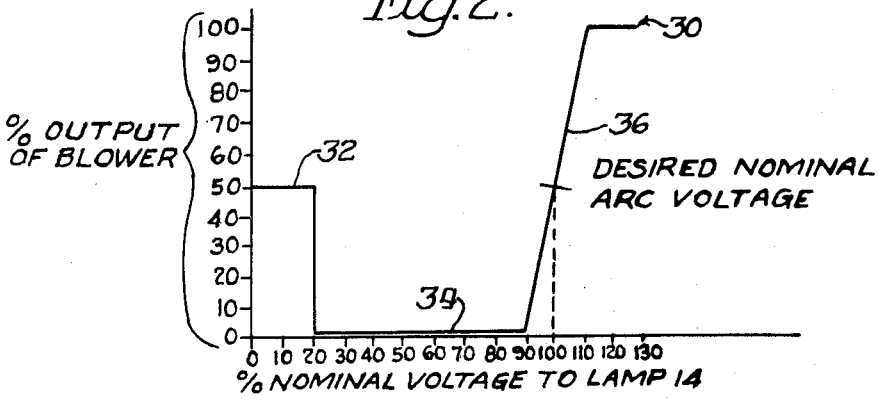
FIG. 2 is a diagrammatic representation of the operating characteristics of the control arrangement of FIG. 1 during various operational modes of the projection lamp.

Referring now additionally to FIG. 2, the lamp sensing and blower control stage 20 in a specific embodiment is arranged to operate in accordance with a predetermined characteristic 30 relating the operating voltage of the projection lamp 14 and the output of the blower 24 to achieve a desirable and accurate operating point of the projection lamp 14. When the projection lamp 14 is in the lamp-off mode represented by no voltage output from the projection power supply 12, the lamp sensing and blower control stage 20 maintains the blower motor 24 at a point equal to approximately 50% of the blower output capacity in a preferred embodiment depicted by section 32 of the predetermined characteristic 30 of FIG. 2. In other specific embodiments, blower output capacities of 25% to 75% are provided in the lamp-off mode section 32. When the operating voltage to the lamp 14 is between approximately 20 to 90% of the nominal operating voltage as during start up, the blower motor 24 is maintained inoperative or at a low operating capacity as depicted by section 34 of the predetermined characteristic 30.

During the lamp start up time while the lamp is warming up, a time interval of approximately 30 seconds for one specific lamp is required for the lamp operating voltage to rise from between 40 to 90% of the normal operating level. Thus, with the blower motor 24 in a low output or inoperative state, a rapid start up and warm-up phase is provided.

As the operating voltage to the projection lamp 14 reaches approximately 90% of its nominal operating voltage, the lamp sensing and blower control stage 20 enables the blower motor 24 at a low percentage output of full capacity. As the projection lamp 14 warms up and the operating voltage increases toward 100% of the normal operating voltage, the blower 24 is maintained at approximately 50% of output capacity by the lamp sensing and blower control stage 20.

During the phase 1 starting pulse, the lamp sensing and blower control stage 20 is protected by internal circuitry and does not respond to the high voltage starting pulse. Further, during the brief phase 2 period, the lamp sensing and blower control stage 20 is responsive to briefly operate the blower 24. In specific embodiments, the lamp sensing and blower control stage 20 is arranged to be non-responsive to the brief duration of the higher voltages during phase 2.

After the start up and warm-up phase, the operating voltage of the projection lamp 14 is approximately 100% and the lamp sensing and blower control stage 20 accurately maintains the operating point of the projection lamp 14 by means of the variable output control of the blower motor 24. As the operating voltage of the projection lamp 14 deviates from the nominal or 100% operating point, the lamp sensing and blower control stage 20 senses the deviation and varies the output of the blower motor 24 to maintain an operating voltage very near the 100% desired operating point in accordance with the closed loop arrangement and the overall loop gain established by the projection lamp control arrangement 10.

Typically, in one specific embodiment, the operating voltage of the projection lamp 14 is held to approximately ±3% of the nominal 100% operating voltage for the typical range of manufacturing parameters in production lamps.

The variable output characteristics of the blower motor 24 as controlled by the lamp sensing and blower control stage 20 in response to sensed deviations of the operating voltage of the projection lamp 14 in the closed loop arrangement is depicted by section 36 of the predetermined characteristic 30 of FIG. 2. Thus, as the operating voltage of the projection lamp 14 moves from between 90 and 110% of the desired operating voltage point, the blower output is varied by the lamp sensing and blower control stage 20 from approximately 0 to 100% of the blower output capacity. A control power supply stage 40 supplies the blower motor driver stage 26 and the blower motor 24 with suitable operating supplies. In specific embodiments, the power supply stage 40 also includes a ground isolated supply output to the lamp sensing and blower control stage 20.

Figure 3:
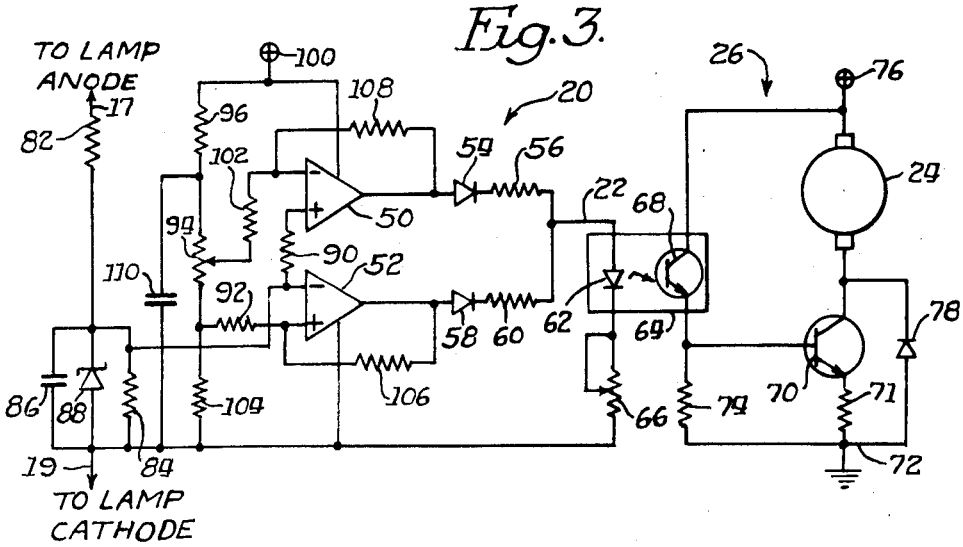
FIG. 3 is an electrical schematic representation of a preferred embodiment of the control arrangement of FIG. 1.

In a specific embodiment of the present invention and referring now to FIG. 3, the lamp sensing and blower control stage 20 includes two operational amplifiers or analog comparators 50 and 52 to sense the operating voltage to the anode and cathode electrodes 16, 18 of the projection lamp 14 and to control the output 22 to the blower motor driver stage 26. The output of the amplifier 50 is connected through the series combination of a diode 54 anode to cathode and a resistor 56 to the output 22. Similarly, the output of the amplifier 52 is connected through the series combination of a diode 58 anode to cathode and a resistor 60 to the output 22.

The amplifier 50 senses the operating voltage to the projection lamp 14 and provides the sloped characteristic section 36 of FIG. 2. The amplifier 52 senses the operating voltage to the projection lamp 14 and provides the characteristic sections 32 and 34 of FIG. 2 to control the blower output characteristics during the lamp-off periods and the warm-up time.

The output 22 of the lamp sensing and blower control stage 20 is connected to the anode of an LED 62 of an opto-coupler device 64 of the blower motor driver stage 26. The cathode of the LED 62 is connected through a potentiometer 66 arranged as a variable resistor to the cathode supply line 19. The cathode supply line 19 is utilized as a reference potential for the lamp sensing and blower control stage 20. The opto-coupler device 64 includes a photosensitive NPN transistor 68. The emitter of the transistor 68 is connected to the base of an NPN driver transistor 70 and also to a ground reference potential 72 through a resistor 74. The collector of the driver transistor 70 is connected through the armature circuit of the blower motor 24 to a DC motor supply source 76. The DC motor supply source 76 is also connected to the collector of the opto-coupler transistor 68. A diode 78 is connected cathode to anode between the collector of the driver transistor 70 and the ground reference 72. The emitter of the driver transistor 70 is connected through a resistor 71 to the ground reference 72. The opto-coupler device 64 is provided since the lamp sensing and blower control stage 20 senses operating voltage across the supply lines 17, 19 and the projector lamp power supply 12 in many specific embodiments is not isolated from the power line; i.e. the projector lamp supply 12 must be isolated from the ground reference circuits of the projection apparatus.

Considering now the details of the lamp sensing and blower control stage 20, the anode supply line 17 is connected through a series resistor 82 to an inverting input of the amplifier 52. The junction of the resistor 82 and the inverting input of the amplifier 52 is also connected through the parallel combination of a resistor 84 and a capacitor 86 to the cathode supply line 19. A zener diode 88 includes an anode connected to the cathode supply line 19 and a cathode connected to the junction of the resistors 82, 84. The zener diode 88 in a specific embodiment is a 6 v diode corresponding to a supply voltage to the amplifiers 50, 52 of approximately 6 VDC. The capacitor 86 along with the resistor 82 functions to eliminate high voltage transients such as the starting pulse from appearing across the zener diode 88 and the amplifiers 50, 52.

The non-inverting input of the amplifier 50 is connected through a resistor 90 to the inverting input of the amplifier 52. A non-inverting input of the amplifier 52 is connected through three series resistors 92, 94 and 96 to a reference supply 100. In a specific embodiment, the reference supply is 6 VDC and is derived from the projection lamp power supply 12 or other ground isolated supply means. The resistor 94 is a potentiometer with the variable tap lead connected through a series resistor 102 to the inverting input of the amplifier 50. A resistor 104 is connected between the junction of resistor 92 and 94 and the cathode supply line 19. The non-inverting input and the output of the amplifier 52 are connected through a feedback resistor 106. The inverting input and the output of the amplifier 50 are connected through a feedback resistor 108. A capacitor 110 is connected between the cathode supply line 19 and the junction of the resistors 94 and 96. The amplifiers 50 and 52 include power supply connections between the reference supply line 100 and the cathode supply line 19. The variable resistor 66 is utilized to adjust the overall loop gain of the system and the potentiometer 94 adjusts the desired operating sense point of the control circuit 10.

In operation and with a voltage input on lines 17, 19 equal to 20% or less of the nominal lamp operating voltage, the amplifier 50 does not produce an output higher than the potential of the cathode supply line 19 and the amplifier 52 is arranged to supply an output at 22 to activate the LED 62 of the opto-coupler 64 at a current level to control the blower motor driver stage 26 to maintain operation of the blower motor 24 at approximately 50% of the total output capacity. Thus, the transistor 68 of the opto-coupler is rendered conductive at a level to forward bias the transistor 70. In response, the transistor 70 is conductive at a level that establishes a collector voltage at a point between the supply 76 and the ground reference 72 to operate the blower motor 24 at approximately 50% of capacity.

With an operating voltage on the supply lines 17, 19 between approximately 20 and 90% of the nominal operating lamp voltage, neither of the amplifiers 50 or 52 produces an output at 22 to actuate the LED 62 and thus the blower motor 24 is inactive or stopped. In an alternative specific embodiment, a predetermined low operational level through amplifier 52 is provided when the lamp is operating at points between 20 and 90%. However, in the preferred embodiment to realize the fastest warm-up time, the blower motor 24 is rendered inoperational during the 20 to 90% portion of operating voltage during the warm-up period of the lamp 14.

With the operating voltage between 20 and 90%, the voltage at the inverting input of amplifier 52 produces a low output signal at the output of the amplifier 52. Further, the input at the amplifier 50 is not sufficient to generate a high output level at the output of the amplifier 50 and the LED 62 is not actuated.

When the operating voltage is approximately 90% or greater, the amplifier 52 continues to output a low level so as not to actuate the LED indicator 62 but the amplifier 50 receives an input at the non-inverting input sufficient to produce an output level relative to the cathode supply line 19 to provide current through and actuation of the LED 62. Thus, as the operating voltage increases between 90 and 110%, the output of the amplifier 50 provides increasing drive levels through the LED 62 and increased blower output of the blower motor 24 results in accordance with the predetermined characteristic section 36 of FIG. 2. Thus, the output of the blower 24 is widely varied over approximately 0 to 100% of output capacity as the operating voltage of the projection lamp 14 deviates approximately ±10% from the desired, nominal operating voltage.

Due to the closed loop arrangement, as the operating voltage of the projection lamp 14 deviates from the nominal operating point, the output of the blower motor 24 varies to track out the deviation in the operating point and drive the operating point back toward the 100% nominal operating point.

In a specific circuit implementation, it has been found that the closed loop arrangement of the control circuit 10 can accurately maintain the operating voltage to within ±3% of the nominal operating point with variations in the characteristics of the projection lamps 14.

Due to the closed loop arrangement to control the output of the blower motor 24, it should be realized that voltage variations of the various supply lines has very little or no effect on maintenance of the operating point at the 100% nominal operating point.

As the voltage at output 22 increases above the lamp cathode supply line 19, the drive through the LED 62 also increases rendering transistor 68 and 70 more conductive to increase the output of the blower motor 24 by providing increased operating voltage across the blower motor 24. The amplifiers 50 and 52 by means of the diode connections through diodes 54 and 58 provide an analog "OR" control arrangement whereby positive output signals from either of the amplifiers 50 or 52 above the cathode supply line 19 provide an output at 22 without loading or affecting the other of the amplifiers 50, 52.

While there has been illustrated and described several embodiments of the present invention, it will be apparent that various changes and modifications thereof will occur to those skilled in the art. It is intended in the appended claims to cover all such changes and modifications as fall within the true spirit and scope of the present invention.

I claim:

1. A control arrangement for accurately maintaining the operating point of a projection lamp in projection apparatus having a projection lamp power supply, the control arrangement comprising:

means having a controllable variable output for providing control of the operating temperature of said projection lamp, said variable output being controllable over a predetermined range of output capacity, and means responsive to the power input to said projection lamp for controlling operation of said controllable variable output means, said controlling means comprising means for sensing the deviation of said power input of said projection lamp from a predetermined operating point and means responsive to said deviation sensing means for modifying the output of said controllable variable output means whereby said projection lamp is maintained at a constant operating temperature, said modifying means modifying the output of said controllable variable output means according to a predetermined relationship relating the sensed deviation of said power input and the output of said controllable variable output means.

2. The control arrangement of claim 1 wherein said projection lamp power supply is a constant current power supply and said controlling means is responsive to the voltage across said projection lamp.

3. The control arrangement of claim 2 wherein said controlling means is effective to produce a predetermined change in the output of said controllable variable output means in response to a predetermined change in said projection lamp voltage in accordance with a predetermined transfer characteristic.

4. The control arrangement of claim 1 wherein said controllable variable output means is electrically powered and said controlling means further comprises means for electrically isolating the electrical circuit of said controllable variable output means from said controlling means.

5. The control arrangement of claim 3 wherein said electrically isolating means comprises opto-coupler means, said opto-coupler means comprising variable energizable activating means selectively actuated by said controlling means and photosensitive means responsive to said variable energizable activating means for controlling said controllable variable output means.

6. The control arrangement of claim 1 or 4 wherein said controllable variable output means comprises blower means for providing variable air circulation to said projection lamp in response to said controlling means.

7. The control arrangement of claim 1 wherein said controllable variable output means and said controlling means operate on a closed loop basis, said predetermined relationship relating the projection lamp voltage and the output of said controllable variable output means as a percentage of maximum capacity.

8. The control arrangement of claim 1 wherein said modifying means comprises means for transforming said sensed power deviation into a percentage change in said output of said controllable variable output means.

9. The control arrangement of claim 7 wherein said percentage change represents a percentage of the maximum output capacity of said controllable variable output means.

10. The control arrangement of claim 1 wherein said controlling means further comprises means for operating said controllable variable output means at a first predetermined output level in response to a projection lamp off-mode wherein no power is being inputted to said projection lamp and a second predetermined output level in response to a power input to said projection lamp greater than zero and less than the normal operating range as during the start-up mode of said projection lamp, said controlling means controlling operation of said controllable variable output means in accordance with said predetermined relationship when said power input to said projection lamp is in the normal operating range in response to said sensed deviation.

11. The control arrangement of claim 10 wherein said predetermined relationship defines the change in output of said controllable variable output means in response to said sensed power deviation from a predetermined operating point.

12. The control arrangement of claim 11 wherein said predetermined relationship includes a variation in the output of said controllable variable output means over a substantial portion of the maximum capacity of said controllable variable output means in response to a relatively small percentage deviation of said power input to said projection lamp from said predetermined operating point.

13. The control arrangement of claim 12 wherein said predetermined relationship includes a variation of said output of said controllable variable output means of at least one-half of said maximum capacity of said controllable variable output means in response to a deviation of said projection lamp operating point of not more than plus or minus ten percent of said power input to said projection lamp at said predetermined operating point.

14. The control arrangement of claim 10 wherein said second predetermined output level is approximately zero.

15. The control arrangement of claim 10 wherein said first predetermined output level is in the range of from 25 to 75% of said maximum output capacity.

16. The control arrangement of claim 10 wherein said controllable variable output means comprises an air flow control device.

17. The control arrangement of claim 1 or 10 wherein said projection lamp is a metal arc lamp.

18. Apparatus for maintaining the operating point of a projection lamp in projection apparatus having a projection lamp power supply, the apparatus comprising:

blower means controllable over a control input for providing variable air circulation to said projection lamp, said blower means being controllable over said control input to continuously operate over a predetermined operating range of output capacity; and means responsive to the power input to said projection lamp for controlling operation of said blower means over said control input, said controlling means comprising closed loop control means for modifying the output of said blower means in accordance with a predetermined relationship between the power input to said projection lamp and the control input to said blower means to maintain said projection lamp at a constant operating temperature.

19. The apparatus of claim 18 wherein said projection lamp power supply is a constant current power supply and said controlling means is responsive to the voltage across said projection lamp.

20. The apparatus of claim 18 wherein said controlling means is responsive to the deviation of said power input of said projection lamp from a predetermined operating point, said predetermined relationship relating said sensed power deviation to a percentage change in the output capacity of said blower means.

* * * * *

UNITED STATES PATENT AND TRADEMARK OFFICE

CERTIFICATE OF CORRECTION

PATENT NO. : 4,283,658
DATED : August 11, 1981
INVENTOR(S) : Robert R. Parker

It is certified that error appears in the above-identified patent and that said Letters Patent are hereby corrected as shown below:

Column 4, line 5, change "application" to --applications--;

Claim 5, line 1, change "3" to --4--;

Claim 6, line 1, change "4" to --5--; and

Claim 9, line 1, change "7" to --8--.

Signed and Sealed this

*Fifth* Day of *January 1982*

[SEAL]

*Attest:*

GERALD J. MOSSINGHOFF

*Attesting Officer*

*Commissioner of Patents and Trademarks*